US011878838B2

(12) United States Patent
Martin et al.

(10) Patent No.: US 11,878,838 B2
(45) Date of Patent: Jan. 23, 2024

(54) PALLET APPARATUS

(71) Applicant: Xcel Global Packaging Inc., Tillsonburg (CA)

(72) Inventors: Jean Martin, Tillsonburg (CA); Henry Braun, Tillsonburg (CA)

( * ) Notice: Subject to any disclaimer, the term of this patent is extended or adjusted under 35 U.S.C. 154(b) by 0 days.

(21) Appl. No.: 17/693,670

(22) Filed: Mar. 14, 2022

(65) Prior Publication Data

US 2022/0297885 A1 Sep. 22, 2022

Related U.S. Application Data

(60) Provisional application No. 63/161,536, filed on Mar. 16, 2021.

(51) Int. Cl.
*B65D 19/44* (2006.01)
*B65D 19/00* (2006.01)

(52) U.S. Cl.
CPC ..... *B65D 19/44* (2013.01); *B65D 19/0018* (2013.01)

(58) Field of Classification Search
CPC ..... B65D 19/44; B65D 19/0018; B65D 2519/00935
USPC ..... 108/55.1, 55.3, 55.5
See application file for complete search history.

(56) References Cited

U.S. PATENT DOCUMENTS 3,499,398 A * 3/1970 Murray ..... B65D 19/385 108/53.5
4,240,359 A * 12/1980 Howe ..... B65D 88/129 108/56.1
4,241,892 A * 12/1980 Morris ..... B65D 25/24 428/116
4,309,013 A * 1/1982 Howe ..... B65D 88/129 108/56.1
4,445,616 A * 5/1984 Mancusi ..... B65D 85/68 211/85.8
4,915,033 A * 4/1990 Bond ..... B65D 19/44 108/55.1
4,977,836 A * 12/1990 Bond ..... B65D 19/44 248/346.02
5,190,273 A * 3/1993 Salvagnini ..... B25B 5/061 269/21

(Continued)

FOREIGN PATENT DOCUMENTS

EP 1857371 A1 11/2007
EP 2607257 A1 * 6/2013 ..... B65D 19/0095
JP 2018002199 A * 1/2018

*Primary Examiner* — Jose V Chen
(74) *Attorney, Agent, or Firm* — BERESKIN & PARR LLP/S.E.N.C.R.L., s.r.l.

(57) ABSTRACT

A pallet for carrying an object. The pallet may include a receiving surface to support the object. The pallet may include a socket and may be part of a pallet assembly including a rotationally asymmetrical positioning rod operable to be selectively repositioned within the socket with a main body extending above the receiving surface to restrain a lateral movement of the object. The pallet may include a support frame to support the plurality of objects thereon. The support frame may including a plurality of post supports. The pallet may include a plurality of stacking post assemblies each including a first post having a bottom end pivotally secured to the support frame and a second post operable to move between an extended position engaged with the post support and the first post and a retracted positon engaged with only one of the post support and the first post.

20 Claims, 8 Drawing Sheets

(56) References Cited

U.S. PATENT DOCUMENTS

| | | | | | |
|---|---|---|---|---|---|
| 5,193,700 | A * | 3/1993 | Lyman | B65D 19/44 | 206/386 |
| 5,404,821 | A * | 4/1995 | Bond | B65D 19/44 | 108/55.1 |
| 5,413,054 | A * | 5/1995 | Collins | B65D 19/44 | 108/55.3 |
| 6,044,773 | A * | 4/2000 | Bauer | B25H 1/12 | 108/55.3 |
| 7,044,066 | B1 * | 5/2006 | Miller | B65D 19/44 | 108/55.3 |
| 7,077,067 | B2 * | 7/2006 | Bodde | B65D 19/44 | 108/55.1 |
| 7,784,613 | B2 * | 8/2010 | Angeletti | B65D 19/44 | 220/6 |
| 7,802,526 | B2 * | 9/2010 | Brady | B65D 19/12 | 108/53.5 |
| 8,225,494 | B2 * | 7/2012 | Lauzier | B65D 19/44 | 29/709 |
| 9,394,100 | B2 * | 7/2016 | Glover | B65D 19/06 | |
| 10,189,601 | B2 | 1/2019 | Grutt | | |
| 2017/0015005 | A1 * | 1/2017 | Joplin | B65B 9/045 | |
| 2018/0265249 | A1 * | 9/2018 | Grutt | B65D 19/0073 | |
| 2019/0276187 | A1 * | 9/2019 | Tamura | B65D 25/10 | |
| 2021/0180745 | A1 * | 6/2021 | Aliwi | B65D 85/68 | |
| 2021/0229866 | A1 * | 7/2021 | Lam | B65D 19/44 | |
| 2021/0341094 | A1 * | 11/2021 | Jacobs, II | B65D 85/68 | |
| 2021/0380311 | A1 * | 12/2021 | Schwarz | B65D 19/0002 | |

* cited by examiner

PALLET APPARATUS

CROSS-REFERENCE TO RELATED PATENT APPLICATIONS

This application claims the benefit of U.S. Provisional Patent Application No. 63/161,536 filed Mar. 16, 2021, entitled "PALLET APPARATUS", the entire contents of U.S. Provisional Patent Application No. 63/161,536 is hereby incorporated by reference herein for all purposes.

FIELD

The specification relates generally to apparatuses and methods associated with supporting a plurality of objects, and more specifically to a pallet.

BACKGROUND

U.S. Pat. No. 7,784,613 to Angeletti et al. ("Angeletti") purports to disclose a fully collapsible pallet with easily adjustable rear stops, lower rear stops, and side restraints. Angeletti also purports to disclose a telescoping member provided to allow shipment of partial pallets of windshields. Angeletti also purports to disclose that extensions allow the pallet to be used with windshields of various heights. Angeletti also purports to disclose that the pallet is stackable in a folded condition as well as a loaded condition, even when extensions are used. Angeletti also purports to disclose a latch provided to prevent leaning of the pallet even when the load is not centered in the pallet.

U.S. Pat. No. 9,394,100 to Glover et al. ("Glover") purports to disclose a pallet container for holding vehicle windshields for storage, transportation or otherwise, the pallet container comprising a frame structure defining a base, and a periphery, wherein one or more side restraints are provided to be mounted on board the pallet to inhibit movement of windshields internally of the pallet container, wherein a said side restraint comprises a flexible fluid containing device. Glover also purports to disclose that in an alternative realization the pallet container is expandable in height and length and/or collapsible by means of opposed pivoted side frames and a connecting frame.

SUMMARY

The following summary is intended to introduce the reader to various aspects of the applicant's teaching, but not to define any invention.

According to some aspects, there is provided a pallet assembly for carrying at least one object, comprising a pallet to support the at least one object on a receiving surface thereof, the pallet including at least one socket; at least one positioning rod operable to restrain a lateral movement of the at least one object on the receiving surface, each positioning rod of the at least one positioning rod including a main body and a positioning pin secured to the main body, the positioning pin operable to be removably received in a socket of the at least one socket with the main body extending above the receiving surface to restrain the lateral movement of the at least one object, wherein each positioning rod of the at least one positioning rod is rotationally asymmetrical about a positioning rod longitudinal axis thereof, and is operable to be selectively repositioned within the socket of the at least one socket between at least a first position with the main body in a first orientation and a second positon with the main body in a second orientation different from the first orientation.

In some examples, each socket of the at least one socket is formed in an at least one socket assembly of the pallet and includes a first opening through a first member of the at least one socket assembly and a second opening in a second member of the at least one socket assembly.

In some examples, the first opening is a hole through the first member and the second opening is a hole through the second member or a recess in the second member.

In some examples, the first member is a first plate member and the second member is a second plate member.

In some examples, the at least one socket assembly is on an upper end of the pallet and the first member is an upper member and the second member is a lower member.

In some examples, the receiving surface is formed on the upper member of the at least one socket assembly.

In some examples, the at least one socket is a plurality of sockets.

In some examples, the main body is a first elongated linear body having a main body longitudinal axis and the positioning pin is a second elongated linear body having a pin longitudinal axis, the main body longitudinal axis and the pin longitudinal axis being parallel and offset from one another.

In some examples, each positioning pin has a non-circular cross section to inhibit rotation about a pin longitudinal axis when the positioning pin is received in the socket.

In some examples, the non-circular cross section is octagonal.

In some examples, the positioning pin is plug welded to the main body lower end.

According to some aspects, there is provided a pallet for carrying a plurality of objects, comprising a support frame to support the plurality of objects thereon, the support frame including a plurality of post supports; and a plurality of stacking post assemblies, each stacking post assembly having a post longitudinal axis and including: a first post having a bottom end pivotally secured to the support frame at a pivot connection, the first post pivotally movable about the pivot connection between a vertical positon with the post longitudinal axis generally vertical and a collapsed position overlying the support frame, and a second post operable to move between an extended position engaged with a post support of the plurality of post supports and with the first post to prevent pivotal movement of the first post about the pivot connection and a retracted positon engaged with only one of the post support and the first post to permit pivotal movement of the first post about the pivot connection.

In some examples, the second post is secured to the first post and engaged with the first post when in the retracted position.

In some examples, the second post is in telescoping engagement with the first post.

In some examples, the second post is nested inside the first post.

In some examples, the second post is nested inside the post support when in the extended position.

In some examples, a first pin extends through a first post hole in the first post and a second post slot in the second post and a second pin extends through a first post slot in the first post and a second post hole in the second post, the first and second pins spaced from each other along the post longitudinal axis with the second pin above the first pin in the vertical position, the first pin secured to a pin support of the support frame to form the pivot connection between the first post and the support frame.

In some examples, the support frame has a plurality of corners and the plurality of stacking post assemblies are corner post assemblies each secured to a corner of the plurality of corners.

In some examples, the support frame has a length and a width, the length greater than the width, and a frame longitudinal axis extending along the length, and the first posts are pivotable towards the longitudinal axis.

In some examples, each first post includes a first stacking cap on a top end opposite the bottom end and directed upwards when the first post is in the vertical position, and each first post includes a second stacking cap on a lateral wall of the first post and facing upwards when the first post is in the collapsed position, and each post support extending to a bottom side of the support frame and including a recess on the bottom side of the support frame shaped to selectively receive a corresponding first stacking cap or second stacking cap of another pallet stacked therebelow.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses or process described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim, or dedicate to the public any such invention by its disclosure in this document.

Figure 1:
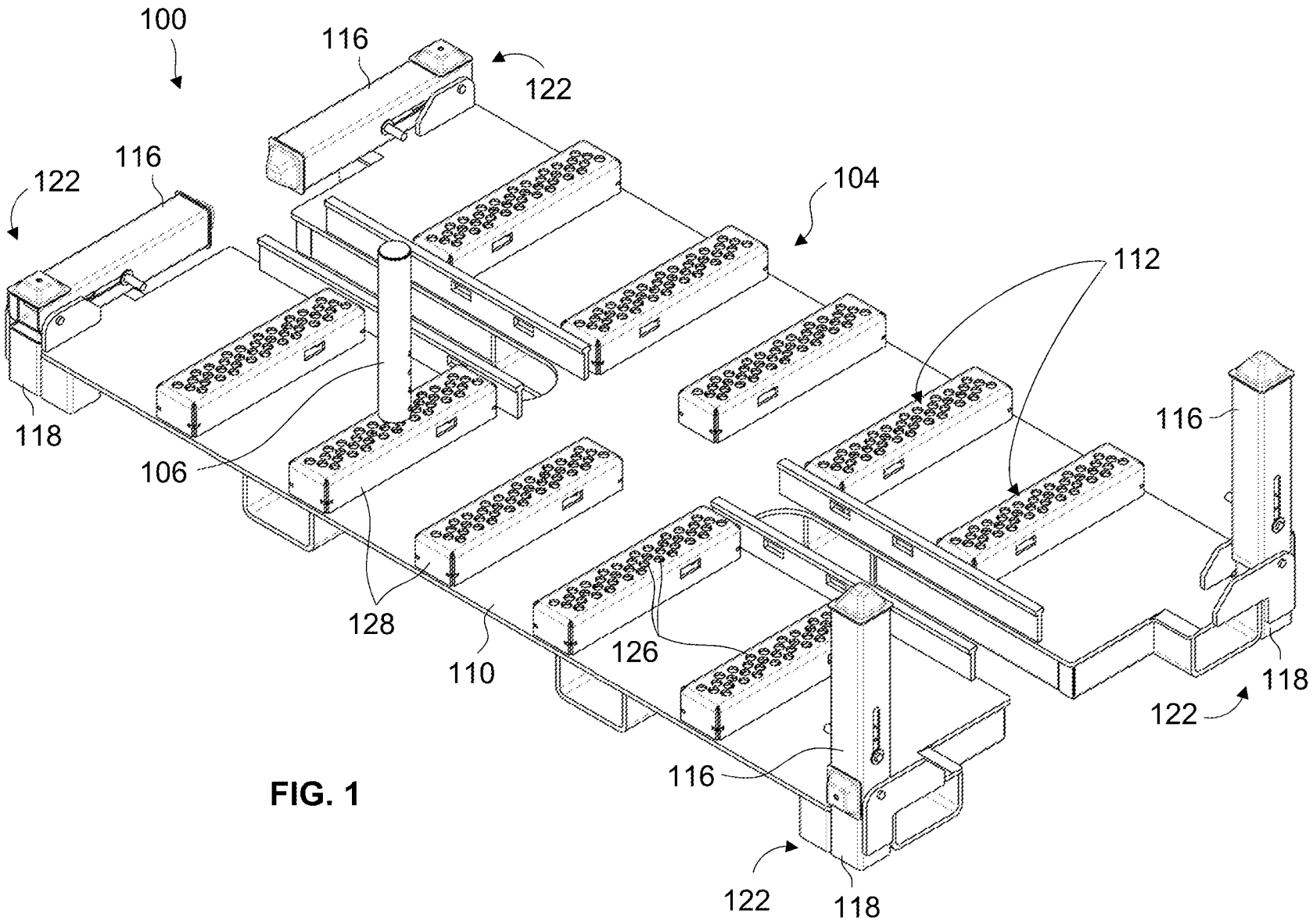
FIG. 1 is a top perspective view of a pallet assembly.
Figure 2:
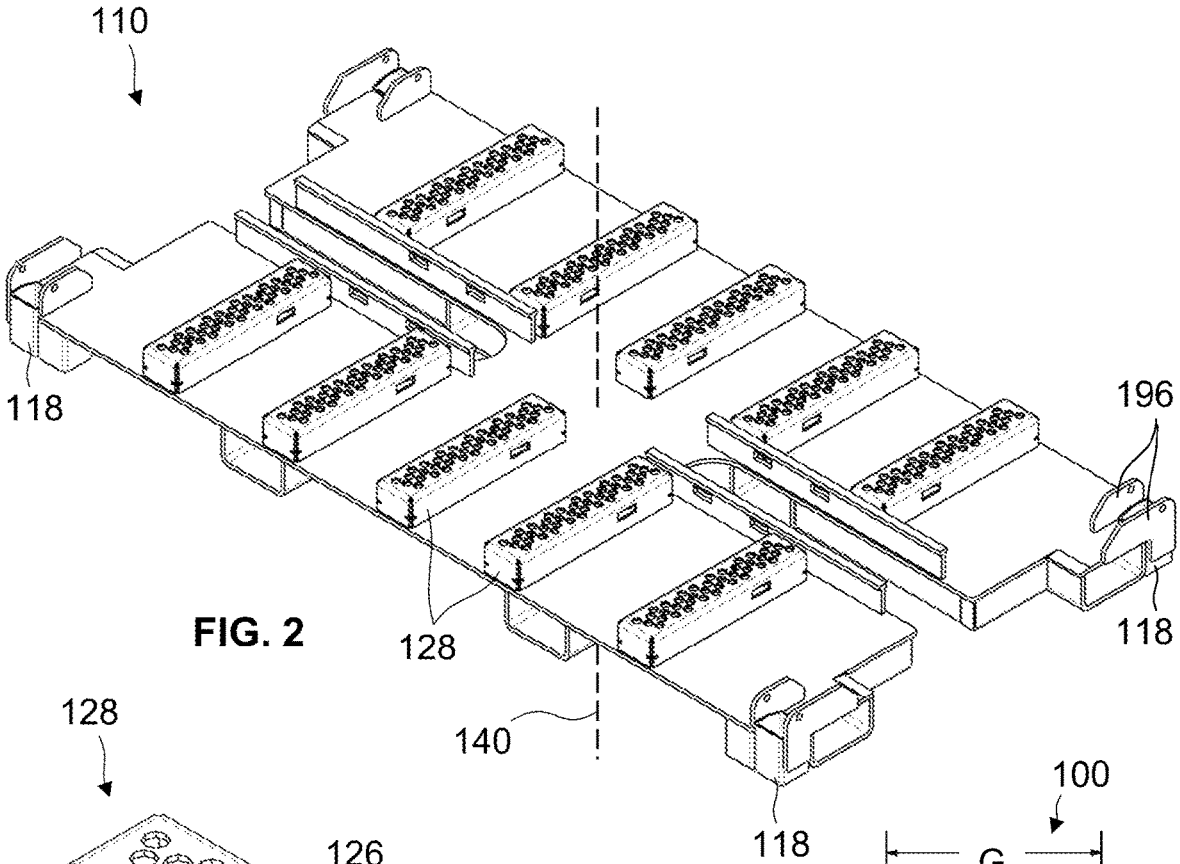
FIG. 2 is a top perspective view of a support frame of the pallet assembly of FIG. 1.
Figure 3:
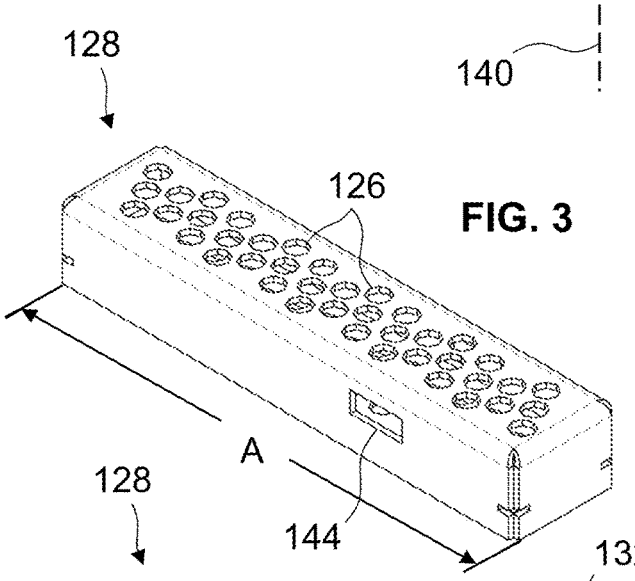
FIG. 3 is a top perspective view of a socket assembly of the pallet assembly of FIG. 1.
Figure 5:
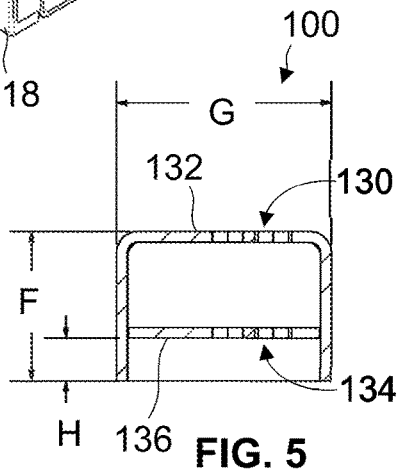
FIG. 5 is a second cross sectional view of the socket assembly of FIG. 3, taken along the line 5-5 of FIG. 4.
Figure 4:
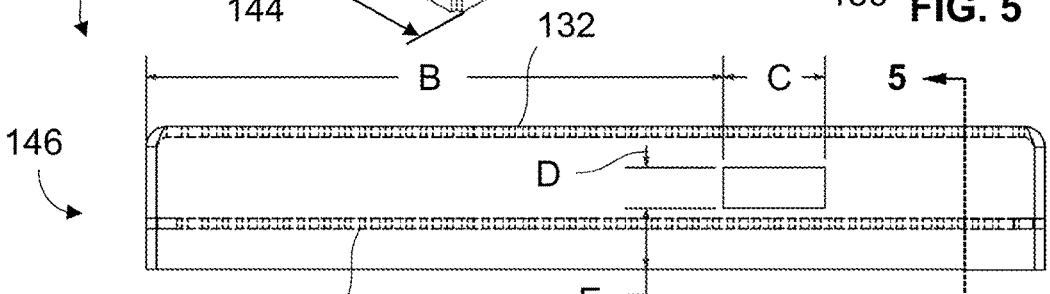
FIG. 4 is a first cross sectional view of the socket assembly of FIG. 3.

Referring to FIG. 1, illustrated is an example of a pallet assembly 100 for carrying one or more objects. For example, the pallet assembly 100 may be for automobile parts such as blanks used inside an assembly factory.

A pallet assembly may be of various shapes and sizes for use with various types of objects. However, in some examples a pallet assembly or a component thereof is adapted for use with existing packaging and logistical practices. The dimensions of a pallet assembly or a component thereof may be maintained within limits to facilitate use with existing packaging and logistical practices, as discussed further below.

A pallet assembly may include a pallet and may be adapted to restrain the movement of the one or more object on the pallet. For example, a pallet assembly may include one or more positioning rod to hold a plurality of objects in position on the pallet by limiting lateral movement of the plurality of objects on the pallet. In the illustrated example, the pallet assembly 100 includes a pallet 104 and a positioning rod 106.

In some examples a pallet includes a support frame. In some examples, a pallet includes a receiving surface to receive at least one object thereon. In some examples, the receiving surface is formed by the support frame. In the illustrated example, the pallet 104 includes a support frame 110 to support a plurality of objects thereon. The illustrated example support frame 110 forms a receiving surface 112 of the pallet 104.

A pallet may be adapted for stacking. For example, a pallet may include one or more posts to support another pallet above. In the illustrated example, the pallet 104 includes a plurality of stacking post assemblies 116 and a plurality of post supports 118 formed in the support frame 110. The plurality of post supports 118 and the plurality of stacking post assemblies 116 are operable to be releasably engaged, as described further below.

Although various numbers and positions of the plurality of stacking post assemblies 116 may be used, in some examples a pallet and/or support frame of a pallet has corners, and the stacking post assemblies 116 are corner post assemblies. In the illustrated example, the pallet 104 is generally rectangular or cuboid in shape, and has four corners 122. A rectangular pallet may be convenient to use, and may facilitate use with existing packaging and logistical practices. Each stacking post assembly 116 is a corner post assembly secured to a corner 122. Four corner post assemblies may provide a firm foundation for a pallet stacked above, while minimizing obstruction to the placement of objects on the pallet.

Referring now to FIGS. 2 to 5, the pallet 104 includes at least one socket 126. The at least one socket 126 is provided to engage the at least one positioning rod 106.

Each socket 126 of the at least one socket 126 is formed in an at least one socket assembly 128 of the pallet 104. In the illustrated example, the pallet 104 includes a plurality of socket assemblies 128, and each socket assembly 128 includes a plurality of sockets 126.

In the illustrated example, each socket 126 is adapted to contact a pin received in the socket 126 at two or more points along the length of the pin to facilitate a firm engagement between the pin and the socket. Each socket 126 includes a first opening 130 through a first member 132 of the at least one socket assembly 128 and a second opening 134 in a second member 136 of the at least one socket assembly 128. The first opening 130 and the second opening 134 are aligned to receive a pin through the first opening 130 and in the second opening 134.

In the illustrated example, each of the first opening 130 and the second opening 134 is a hole through the corresponding member, though the second opening 134 may optionally be a recess or otherwise not extending all the way through the second member. The first member 132 and the second member 136 are also plate members. Plate members may facilitate providing a plurality of sockets 126 in each socket assembly 128. Plate members may facilitate providing the plurality of sockets 126 in the same plane, as illustrated.

Socket assemblies may be formed on an upper end of the pallet and/or adjacent the receiving surface to facilitate use in restraining the movement of objects placed on the pallet. Each illustrated example socket assembly 128 includes the first member 132 as an upper member and the second member 136 as a lower member. Each second member 136 of the illustrated example is spaced from the first member 132 along a vertical axis 140 of the pallet 104.

In the illustrated example, the pallet 104 includes the receiving surface 112. The socket assemblies 128 of the illustrated example form the receiving surface 112 of the pallet 104. The receiving surface 112 may be formed on the support frame 110 and the socket assemblies 128 may be part of or secured to the support frame 110.

In the illustrated example, the socket assembly 128 has an aperture 144. The aperture 144 may be used in some cases for strapping down blanks.

The illustrated socket assembly 128 has a socket assembly length A. Length A may optionally be between 10 inches and 40 inches, and is optionally between 15 inches and 30 inches, and is optionally about 22 inches. A distance B between a socket assembly first end 146 and the aperture 144 may optionally be between 10 and 20 inches, and optionally between 12 inches and 16 inches, and is optionally about 14.13 inches. A length C of the aperture 144 may optionally be between 1 and 4 inches, and is optionally about 2.5 inches. A height D of the aperture 144 may optionally be between 0.5 inches and 2 inches, and is optionally about 1 inch. A distance E between the bottom of the socket assembly and the aperture 144 may optionally be between 0.5 inches and 3 inches, and is optionally about 1.5 inches. A height F of the socket assembly 128 may optionally be between 2 inches and 6 inches, and is optionally about 3.5 inches. A width G of the socket assembly 128 may optionally be between 2 inches and 10 inches, and is optionally about 5 inches. A distance H between the second member 136 and the bottom of the socket assembly 128 may optionally be between 0.5 inches and 2 inches, and is optionally about 1 inch. The aperture 144 may optionally open into the socket assembly 128 through a lateral wall thereof between the first member 132 and the second member 136.

Figure 6:
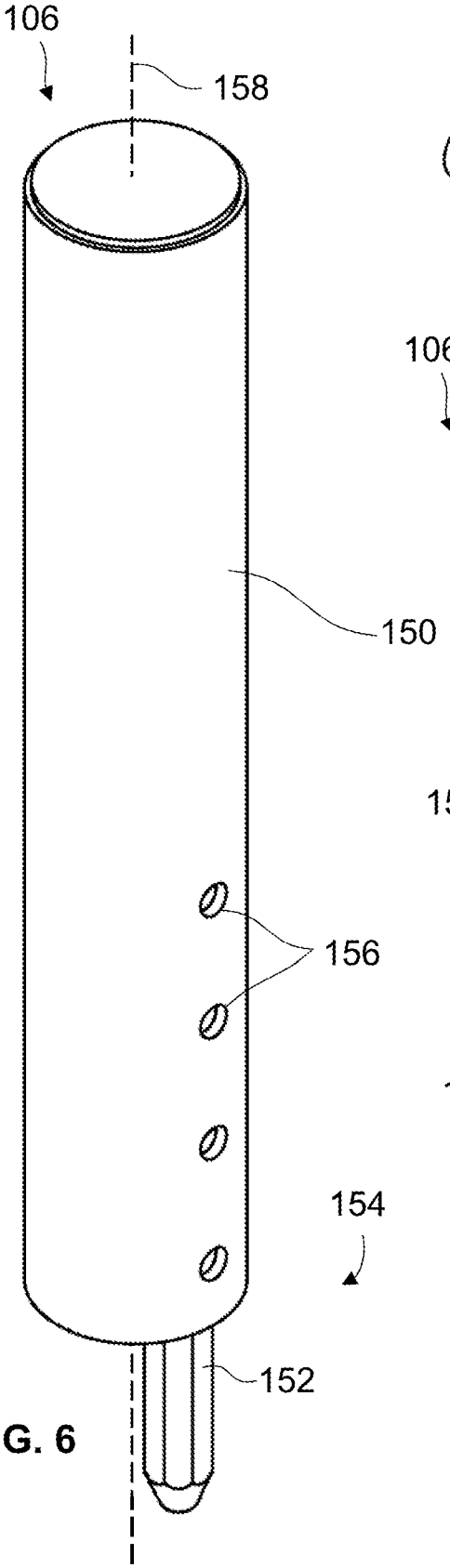
FIG. 6 is a perspective view of a positioning rod of the pallet assembly of FIG. 1.
Figure 7:
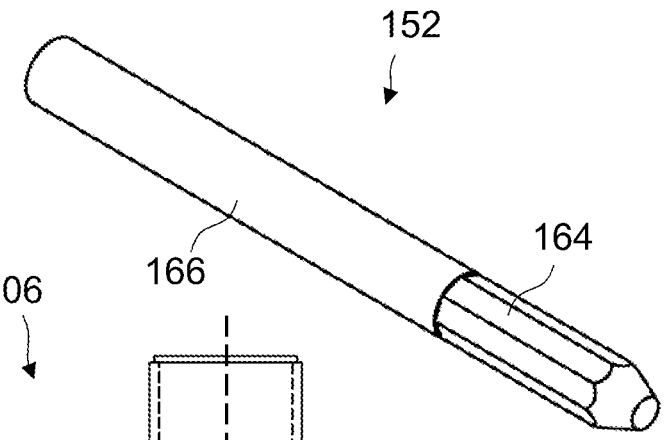
FIG. 7 is a perspective view of a positioning pin of the positioning rod of FIG. 6.
Figure 8:
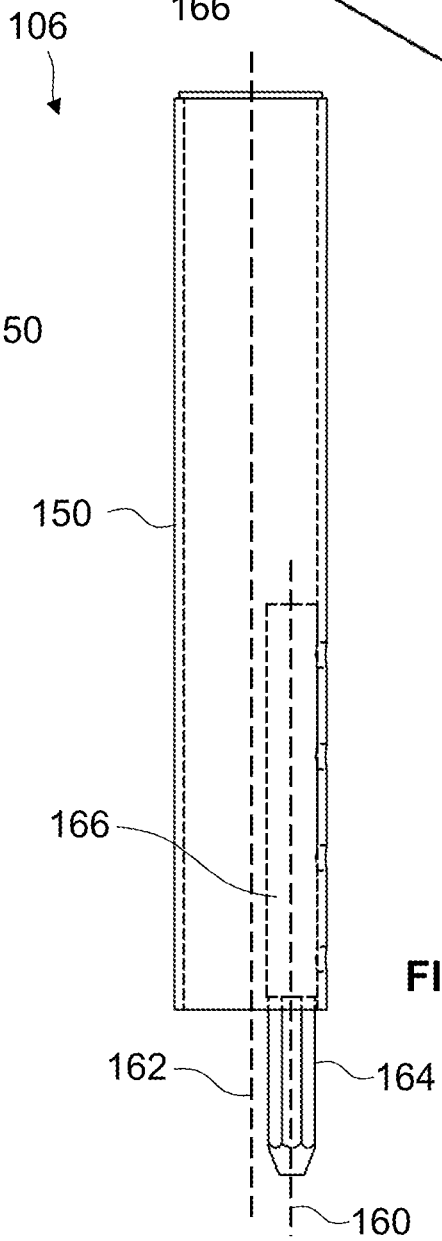
FIG. 8 is a side view of the positioning rod of FIG. 6.

Referring now to FIGS. 6 to 8, illustrated is an example of a positioning rod 106. The positioning rod 106 is operable to restrain a lateral movement of the at least one object on the receiving surface 112.

In some examples, each positioning rod 106 of the at least one positioning rod 106 includes a main body 150 and a positioning pin 152 secured to the main body 150. In some examples, the positioning pin 152 is plug welded to a main body lower end 154 of the main body 150. In the illustrated example, multiple plug welds 156 hold the positioning pin 152 to the main body 150. The positioning pin 152 is operable to be removably received in a socket 126 of the at least one socket 126 with the main body 150 extending above the receiving surface 112 of the pallet 104 to restrain the lateral movement of the at least one object.

A rotationally asymmetrical positioning rod may facilitate a greater range of positions for the positioning rod, since each socket can be used to produce more than one position of the positioning rod if the placement of the positioning rod within the socket is adjusted. Each positioning rod 106 is rotationally asymmetrical about a positioning rod longitudinal axis 158 thereof, and is operable to be selectively repositioned within the socket 126 between at least a first position and a second position. In the first position the main body 150 is in a first orientation, and in the second positon the main body 150 is in a second orientation different from the first orientation. In some examples, the positioning rod 106 is held in a selected position by the socket 126 by the snugness of the fit of the positioning pin 152 in the socket 126.

In the illustrated example, the positioning rod 106 is rotationally asymmetrical about the positioning rod longitudinal axis 158 because the pin longitudinal axis 160 is offset from the main body longitudinal axis 162. Accordingly, the illustrated example positioning rod 106 may be received in a socket 126 with the main body extending further off a first side of the socket than a second side, and the positioning rod 106 can also be repositioned in the same socket 126 with the main body 150 extending further off the second side of the socket 126 than the first side if the positioning pin 152 is rotated in the socket 126.

The positioning rod 106 rod may take on a variety of shapes. For example, the main body 150 may be shaped to engage a particular object, such as being curved. However, in some examples, a linear positioning rod may be more versatile and/or easier to use with the pallet 104. In some examples, the main body 150 is a first elongated linear body and the positioning pin 152 is a second elongated linear body. The main body longitudinal axis 162 and the pin longitudinal axis 160 are parallel and offset from one another.

The positioning pin 152 may be designed to fit snugly in the socket 126. A snug fit may increase the stability of the positioning rod 106. In some examples, each positioning pin 152 has a non-circular cross section to inhibit rotation about the pin longitudinal axis 160 when the positioning pin 152 is received in the socket 126. The non-circular cross section may be only in a lower part 164 of the positioning pin 152, with an upper part 166 of a circular cross section. In the illustrated example, the non-circular cross section is octagonal. The socket 126 may be shaped and/or sized to receive the positioning pin 152 in a secure and/or snug fit. In the illustrated example, the socket 126 is also octagonal, and the positioning rod 106 is accordingly selectively repositionable between six positions in each socket.

In use, one or more objects may be placed on the pallet 104, such as on the receiving surface 112 and/or the support frame 110. One or more positioning pin 152 may then be selectively positioned in a socket 126 with the positioning pin 152 adjacent the one or more objects to prevent the one or more objects from moving laterally past the positioning pin 152. A plurality of positioning pins 152 may be positioned around the one or more objects to hold the one or more objects laterally. The asymmetrical nature of the positioning pins 152 may facilitate a snuggly adjacent positioning of the positioning pins 152 around the at least one object. A snuggly adjacent positioning may prevent the object or objects from being damaged in transit and/or from coming free and falling off of the pallet 104.

Figure 9:
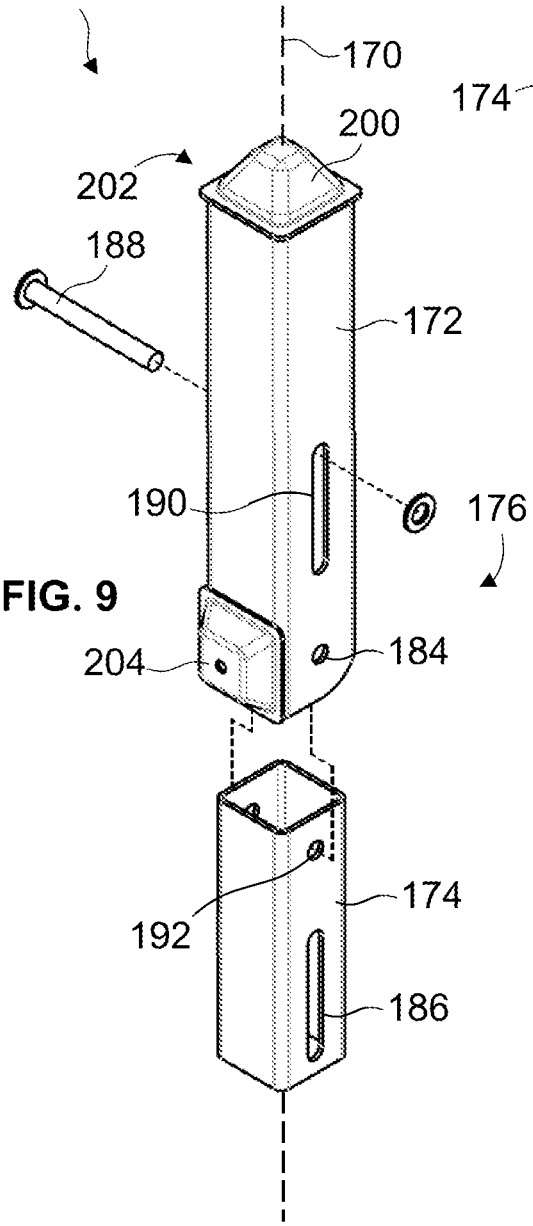
FIG. 9 is an exploded perspective view of a stacking post assembly of the pallet assembly of FIG. 1.
Figure 10:
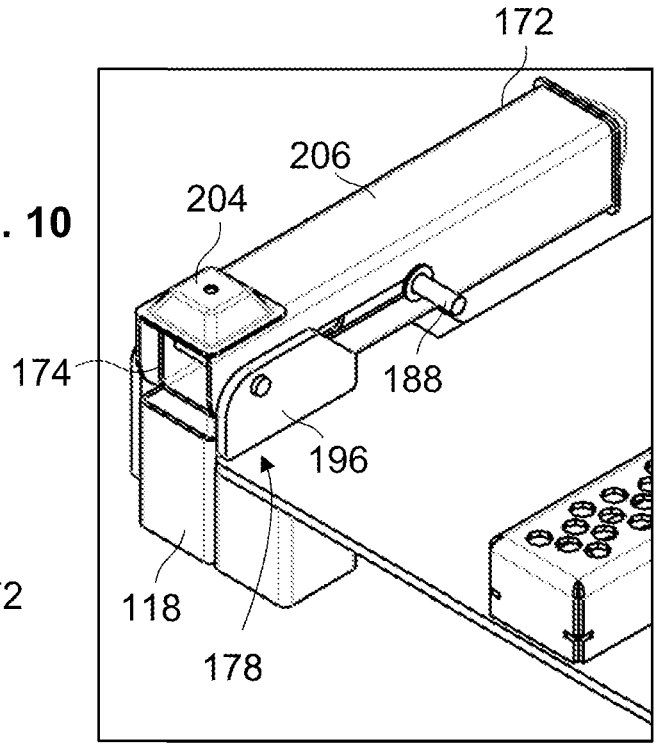
FIG. 10 is an expanded view of a first portion of the pallet assembly of FIG. 1.
Figure 11:
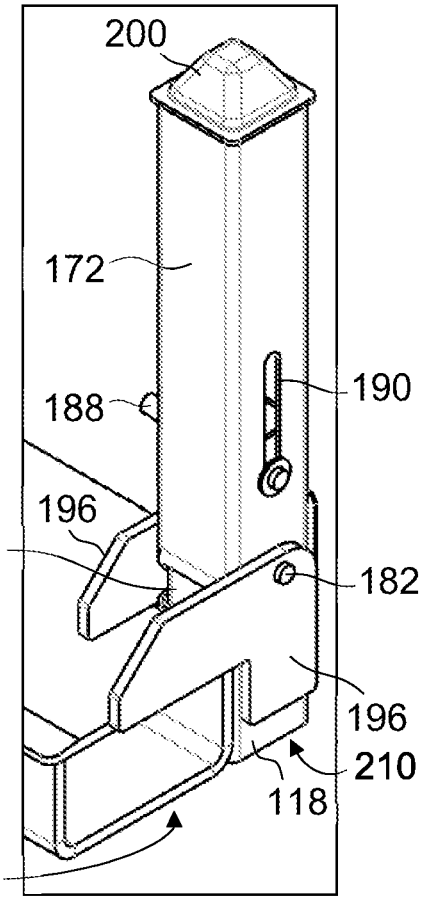
FIG. 11 is an expanded view of a second portion of the pallet assembly of FIG. 1.

Referring now to FIGS. 9 to 11, each illustrated stacking post assembly 116 has a post longitudinal axis 170. Each stacking post assembly 116 includes a first post 172 and a second post 174. The first post 172 has a bottom end 176 pivotally secured to the support frame 110 at a pivot connection 178. The first post 172 is pivotally movable about the pivot connection 178 between a vertical positon (FIG. 11) with the post longitudinal axis 170 generally vertical and a collapsed position (FIG. 10) overlying the support frame 110.

The second post 174 is operable to move between an extended position (FIG. 11) and a retracted position (FIG. 10). In the extended position (FIG. 11), the second post 174 is engaged with the post support 118 of the support frame 110 and with the first post to prevent pivotal movement of the first post 172 about the pivot connection 178. In the retracted positon (FIG. 10), the second post 174 is engaged with only one of the post support 118 and the first post 172 to permit pivotal movement of the first post 172 about the pivot connection 178.

In some examples, the second post 174 is secured to the first post 172, and is engaged with the first post 172 in the retracted position (FIG. 10). In some examples, the second post 174 moves linearly between the extended and retracted positions, and in some examples the second post 174 moves parallel to the post longitudinal axis between the extended and retracted positions.

The second post 174 may be in telescoping engagement with the first post 172. In the illustrated example, the second post 174 is nested inside the first post 172. The second post 174 is also nested inside the post support 118 when in the extended position (FIG. 11).

In some examples, a first pin 182 extends through a first post hole 184 in the first post 172 and a second post slot 186 in the second post 174. A second pin 188 extends through a first post slot 190 in the first post 172 and a second post hole 192 in the second post 174. The first pin 182 and the second pin 188 may be spaced from each other along the post longitudinal axis 170 with the second pin 188 above the first pin 182 when the first post 172 is in the vertical position. The first pin 182 is secured to a pin support 196 of the support frame 110 to form the pivot connection 178 between the first post 172 and the support frame 110. Accordingly, the second post may be drawn up into the first post while the first post remains secured at the pivot connection.

In use, the pallet 104 may be moved to a collapsed position for storage by drawing up the second post 174 into the first post 172 to free the second post 174 from the post support 118. Once the second post 174 is free from the post support 118, the first post 172 is free to pivot about pivot connection 178 into a collapsed position. A collapsed position may be designed to be compact to reduce the space needed to store or transport a pallet 104 in a collapsed position. The use of first and second posts 172 and 174 may facilitate a reduced collapsed height of the pallet 104.

The pallet 104 may also be moved to a vertical position, such as to move the stacking post assemblies 116 out of the way of objects on the pallet 104 or to prepare the pallet 104 to receive another pallet or other object above the pallet 104. The stacking post assemblies 116 may assist in protecting an object or objects on the pallet 104 during transit or storage, even if it is not expected that another pallet 104 or other object will be positioned on top of the pallet 104. The stacking post assemblies 116 may be moved to the vertical position by pivoting the first posts 172 about the pivot connection 178 into a vertical orientation, and then lowering the second posts 174 into engagement with the post supports 118.

Optionally, a pallet may be adapted to engage a pallet below and/or above, such as by including a surface adapted to engage the top of a post of the pallet below. For example, each first post 172 may include a first stacking cap 200 on a top end 202 opposite the bottom end 176. The first stacking cap 200 may be directed upwards when the first post 172 is in the vertical position (FIG. 11). Each first post 172 may also include a second stacking cap 204 on a lateral wall 206 of the first post 172. The second stacking cap 204 may be facing upwards when the first post 172 is in the collapsed position (FIG. 10).

Stacking caps 200, 204 may be formed of or include a softer material than post 172. For example, the stacking post assemblies, socket assemblies, support frame, and positioning pins may be formed of a metal while the stacking caps are formed of a rubbery material.

Each post support 118 may extend to a bottom side 208 of the support frame 110. Each post support 118 may include a recess 210 on the bottom side 208 of the support frame 110 shaped to selectively receive a corresponding first stacking cap 200 or second stacking cap 204 of another pallet stacked therebelow.

Accordingly, in use, the pallet 104 may be stacked on top of another pallet with first stacking caps of the other pallet received in the recesses if post assemblies of the other pallet are in the vertical position, or second stacking caps of the other pallet received in the recesses if post assemblies of the other pallet are in the collapsed position. Similarly, the pallet 104 may have another pallet stacked above with the first stacking caps 200 received in recesses of the other pallet if the post assemblies 116 are in the vertical position, or the second stacking caps 204 received in recesses of the other pallet if the stacking post assemblies 116 are in the collapsed position.

Figure 12:
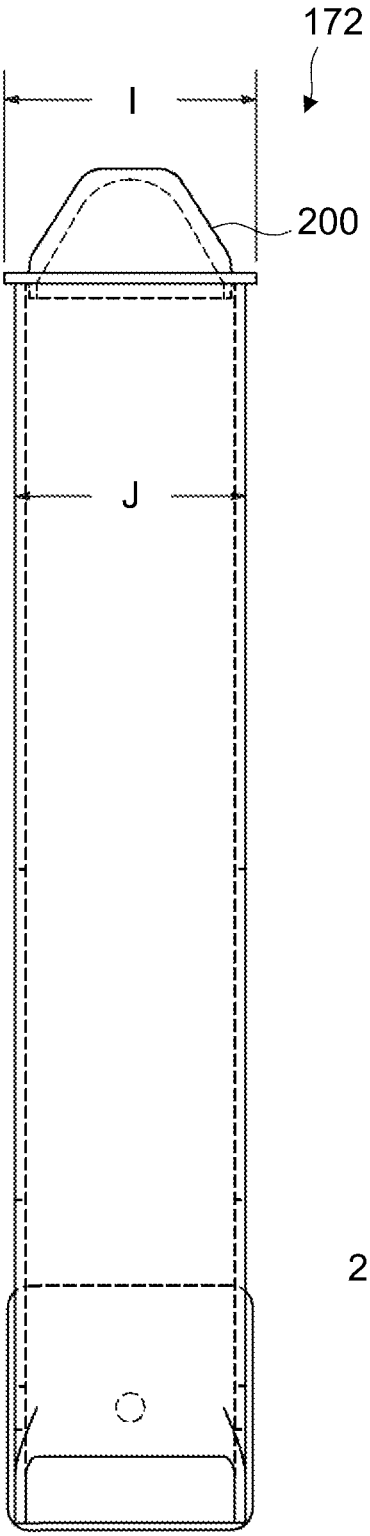
FIG. 12 is an inside side view of a first post of the stacking post assembly of FIG. 9.
Figure 13:
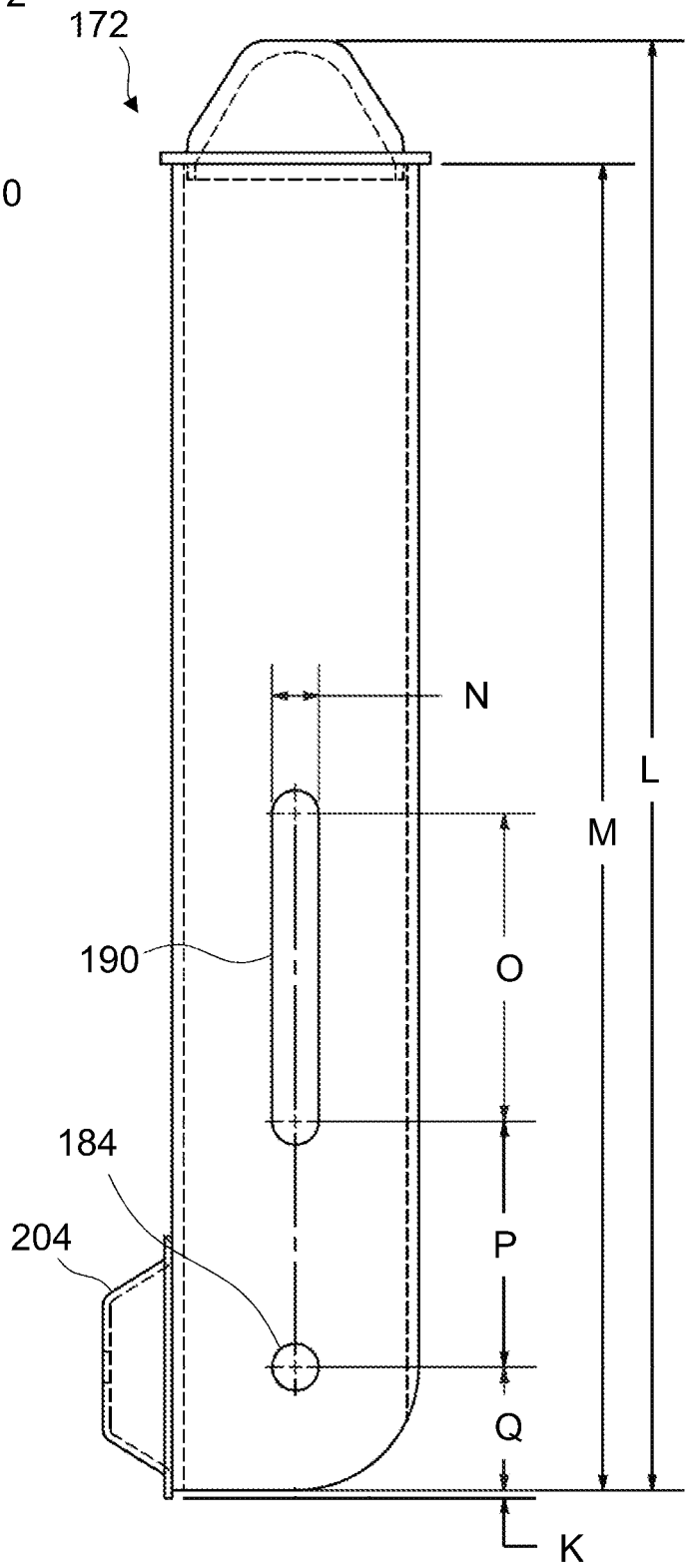
FIG. 13 is an end view of the first post of the stacking post assembly of FIG. 12.

Referring to FIGS. 12 and 13, in some examples the first post 172 has an outside width I including the first stacking cap 200. The outside width I may optionally be between 2 inches and 6 inches, and is optionally about 4.38 inches. The first post 172 may have an inside width J of a main body of the first post 172. The inside width J may optionally be between 2 inches and 6 inches, and is optionally about 4 inches. The first stacking cap 200 may project beyond the main body of the first post 172 by a distance K. Distance K may optionally be between 0.1 inches and 0.5 inches, and is optionally 0.13 inches.

The first post 172 may have a full height L including the first stacking cap 200 that is optionally between 15 inches and 30 inches, and optionally between 20 inches and 25 inches, and optionally about 23.56 inches. The first post 172 may have a main body height M that is optionally between 15 inches and 30 inches, and optionally between 20 inches and 25 inches, and optionally about 21.56 inches.

The first post 172 may have a diameter N of the first post hole 184 that is optionally between 0.25 inches and 1.5 inches, and is optionally about 0.76 inches. The first post 172 may have a first post slot 190 with a length O that is optionally between 2 inches and 8 inches, and is optionally about 5 inches. A separation distance P between the first post hole 184 and the first post slot 190 may be optionally between 2 inches and 6 inches, and is optionally about 4 inches. The first post hole 184 may be spaced a distance Q from the bottom of the first post 172. Distance Q may optionally be between 1 inch and 3 inches, and is optionally 2 inches. The first post hole 184 and the first post slot 190 may be aligned and midway across a lateral wall of the first post.

Figure 14:
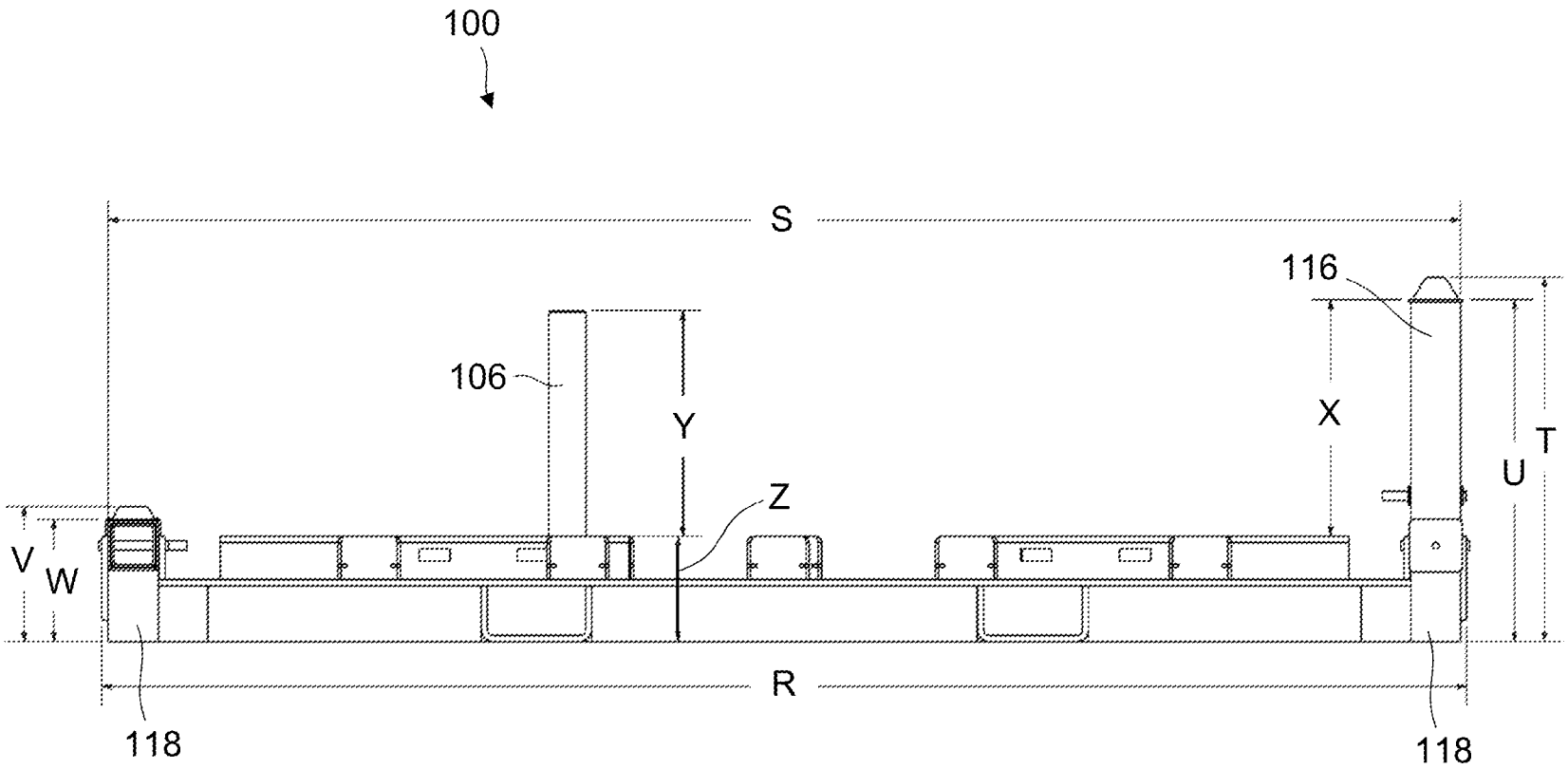
FIG. 14 is a side view of the pallet assembly of FIG. 1.

Referring to FIG. 14, the pallet assembly 100 may have an outside length R that is optionally between 50 inches and 150 inches, and optionally between 75 inches and 125 inches, and optionally about 110 inches. An inside length S, without the pin support 196, may optionally be between 50 inches and 150 inches and optionally between 75 inches and 125 inches, and optionally about 109 inches.

The pallet assembly 100 may have an outside vertical position height T, including first stacking caps 200, that is optionally between 20 inches and 40 inches, and optionally about 29.31 inches. The pallet assembly 100 may have an inside vertical position height U, not including first stacking caps 200, that is optionally between 20 inches and 40 inches, and is optionally about 27.5 inches. The pallet assembly 100 may have an outside collapsed position height V, including second stacking caps 204, that is optionally between 5 inches and 15 inches, and optionally about 10.88 inches. The pallet assembly 100 may have an inside collapsed position height W, not second including stacking caps, that is optionally between 5 inches and 15 inches, and is optionally about 9.87 inches.

The inside vertical position height U may rise a distance X above a top plane of the socket assemblies 128 that is optionally between 10 inches and 30 inches, and is optionally about 19 inches. The main body 150 of the positioning rod 106 may rise a distance Y above the plane of the socket assemblies 128 that is optionally between 10 inches and 30 inches, and is optionally about 18.12 inches. The top plane of the socket assemblies 128 may be a distance Z above the bottom of the pallet assembly 100 that is optionally between 3 inches and 15 inches, and is optionally about 8.5 inches.

Figure 15:
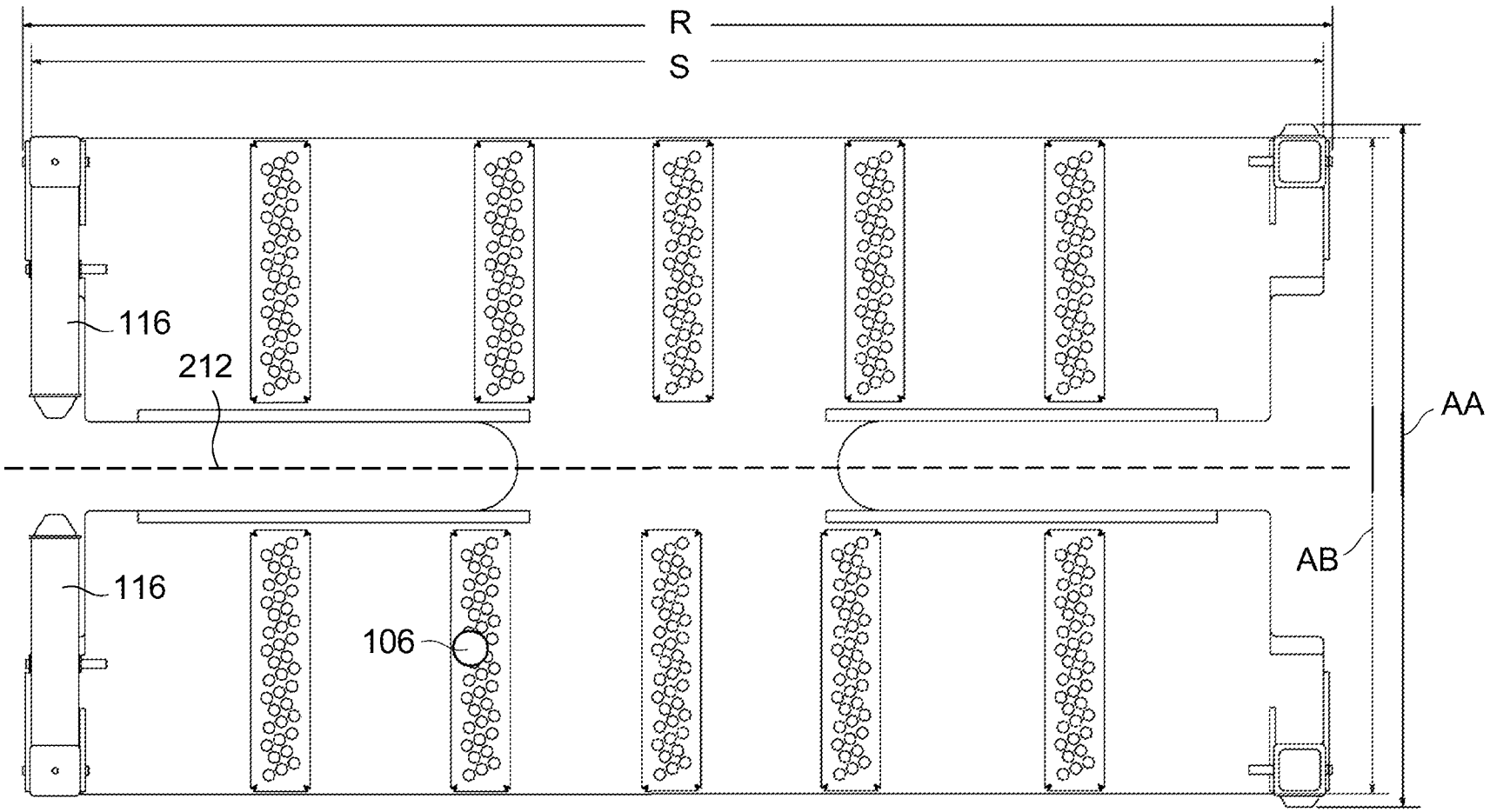
FIG. 15 is a top view of the pallet assembly of FIG. 1.

Referring to FIG. 15, the pallet assembly 100 may have a length that is greater than the width. The pallet assembly 100 may also have a pallet longitudinal axis 212 extending along the length, and the first posts 172 of the at least one stacking post assemblies 116 may be pivotable towards the pallet longitudinal axis 212.

The pallet assembly 100 may have an outside width AA, including second stacking caps 204, that is optionally between 25 inches and 75 inches, and is optionally about 57.5 inches. The pallet assembly 100 may have an inside width AB, not including second stacking caps 204, that is optionally between 25 inches and 75 inches, and is optionally about 55.25 inches.

In some aspects, the I-frame design may be specific to the rigidity and strength preferences of a particular application, such as for a particular customer for example.

Figure 16:
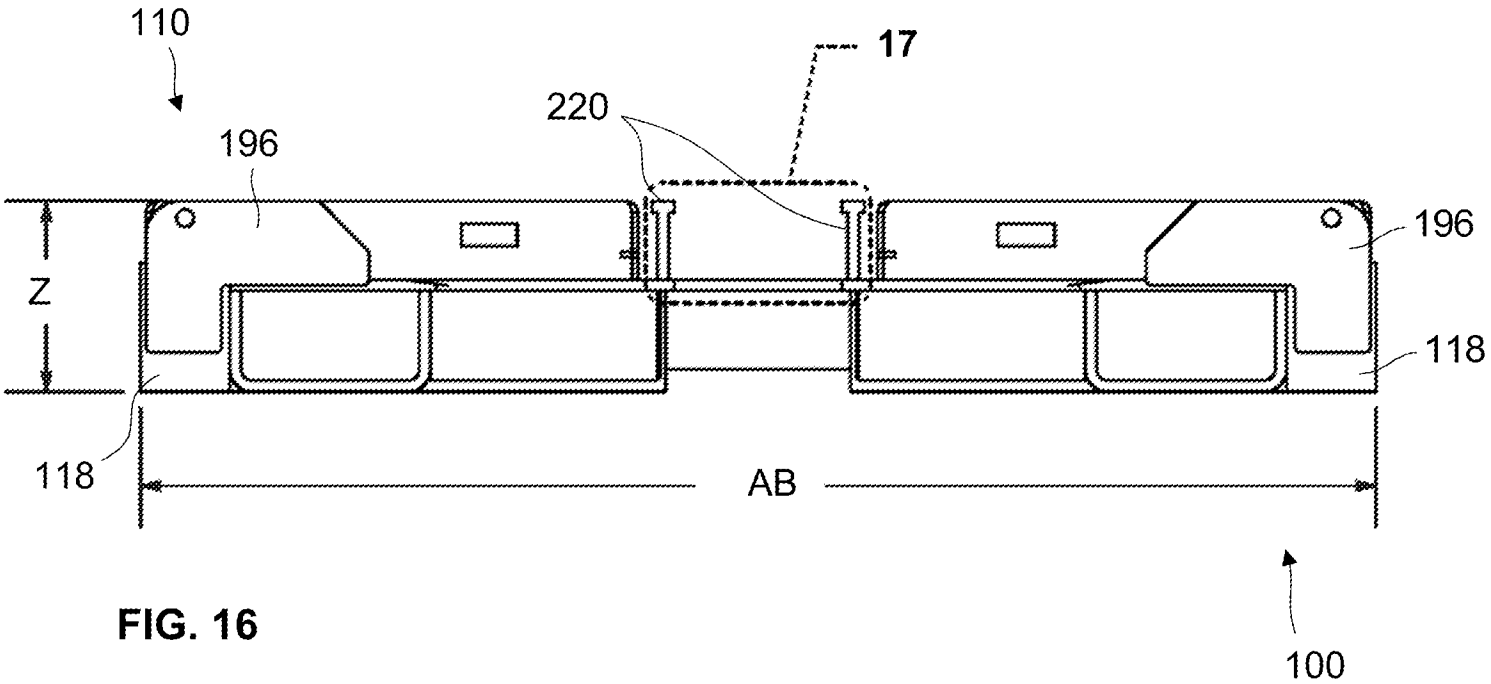
FIG. 16 is an end view of the support frame of FIG. 2.
Figure 17:
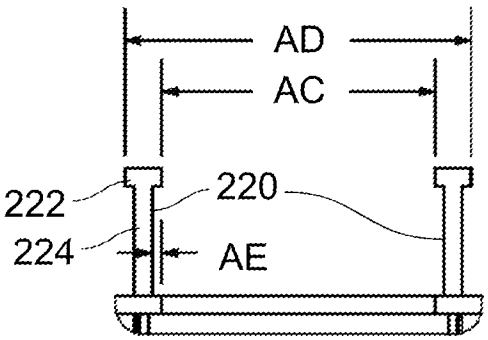
FIG. 17 is an expanded view of a portion of the support frame of FIG. 2, the portion indicated by the circle marked 17 in FIG. 16.

Referring now to FIGS. 16 and 17, pallet 104 may include rails 220. The rails 220 may help ensure that pallet blanks don't move on the pallet 104 in concert with the pins and help ensure the blanks are in a desired position when being introduced to the stamping equipment.

The rails 220 may be spaced a distance AC, which may optionally be between 2 inches and 15 inches, and is optionally 7.5 inches. The outside edges of the rails 220 may be spaced a distance AD, which may optionally be between 2 inches and 15 inches, and is optionally 9.5 inches. The rails 220 may have a head 222 extending a distance AE beyond the web 224. Distance AE may optionally be between 0.1 inches and 1 inch, and is optionally about 0.25 inches.

The invention claimed is:

1. A pallet assembly for carrying at least one object, comprising:

a pallet to support the at least one object on a receiving surface thereof, the pallet including at least one socket;

at least one positioning rod operable to restrain a lateral movement of the at least one object on the receiving surface, each positioning rod of the at least one positioning rod including a main body and a positioning pin secured to the main body, the positioning pin operable to be removably received in a socket of the at least one socket in one of a plurality of rotationally-fixed positions relative to a pin longitudinal axis of the positioning pin and with the main body extending above the receiving surface to restrain the lateral movement of the at least one object, wherein the main body of each positioning rod of the at least one positioning rod is rotationally asymmetrical about the pin longitudinal axis thereof, and the positioning pin is operable to be selectively repositioned within the socket of the at least one socket between at least a first position of the plurality of rotationally-fixed positions with the main body in a first orientation and a second position of the plurality of rotationally-fixed positions with the main body in a second orientation different from the first orientation.

2. The pallet assembly of claim 1, wherein each socket of the at least one socket is formed in an at least one socket assembly of the pallet and includes a first opening through a first member of the at least one socket assembly and a second opening in a second member of the at least one socket assembly.

3. The pallet assembly of claim 2, wherein the first opening is a hole through the first member and the second opening is a hole through the second member or a recess in the second member.

4. The pallet assembly of claim 3, wherein the first member is a first plate member and the second member is a second plate member.

5. The pallet assembly of claim 3, wherein the at least one socket assembly is on an upper end of the pallet and the first member is an upper member and the second member is a lower member.

6. The pallet assembly of claim 5, wherein the receiving surface is formed on the upper member of the at least one socket assembly.

7. The pallet assembly of claim 1, wherein the at least one socket is a plurality of sockets.

8. The pallet assembly of claim 1, wherein the main body is a first elongated linear body having a main body longitudinal axis and the positioning pin is a second elongated linear body having the pin longitudinal axis, the main body longitudinal axis and the pin longitudinal axis being parallel and offset from one another.

9. The pallet assembly of claim 8, wherein each positioning pin has a non-circular cross section to inhibit rotation about the pin longitudinal axis when the positioning pin is received in the socket.

10. The pallet assembly of claim 9, wherein the non-circular cross section is octagonal.

11. The pallet assembly of claim 8, wherein the positioning pin is plug welded to the main body lower end.

12. A pallet for carrying a plurality of objects, comprising:

a support frame to support the plurality of objects on a receiving surface thereof, the support frame including a plurality of post supports each having a fixed position relative to the receiving surface; and a plurality of stacking post assemblies, each stacking post assembly having a post longitudinal axis and including:

a first post having a bottom end pivotally secured to the support frame at a pivot connection adjacent an adjacent post support of the plurality of post supports, the first post pivotally movable about the pivot connection between a vertical position with the post longitudinal axis generally vertical and a collapsed position overlying the support frame, and a second post operable to move between an extended position engaged with the adjacent post support and with the first post to prevent pivotal movement of the first post about the pivot connection and a retracted position relative to the adjacent post support or the first post in which the second post is engaged with only one of the post support and the first post to permit pivotal movement of the first post about the pivot connection.

13. The pallet of claim 12, wherein the second post is secured to the first post and engaged with the first post when in the retracted position.

14. The pallet of claim 12, wherein the second post is in telescoping engagement with the first post.

15. The pallet of claim 14, wherein the second post is nested inside the first post.

16. The pallet of claim 15, wherein the second post is selectively nested inside the post support when in the extended position.

17. The pallet of claim 16, wherein a first pin extends through a first post hole in the first post and a second post slot in the second post and a second pin extends through a first post slot in the first post and a second post hole in the second post, the first and second pins spaced from each other along the post longitudinal axis with the second pin above the first pin in the vertical position, the first pin secured to a pin support of the support frame to form the pivot connection between the first post and the support frame.

18. The pallet of claim 12, wherein the support frame has a plurality of corners and the plurality of stacking post assemblies are corner post assemblies each secured to a corner of the plurality of corners.

19. The pallet of claim 18, wherein the support frame has a length and a width, the length greater than the width, and a frame longitudinal axis extending along the length, and the first posts are pivotable towards the frame longitudinal axis.

20. The pallet of claim 12, wherein each first post includes a first stacking cap on a top end opposite the bottom end and directed upwards when the first post is in the vertical position, and each first post includes a second stacking cap on a lateral wall of the first post and facing upwards when the first post is in the collapsed position, and each post support extending to a bottom side of the support frame and including a recess on the bottom side of the support frame shaped to selectively receive a corresponding first stacking cap or second stacking cap of another pallet stacked therebelow.

* * * * *